US009358602B2

(12) United States Patent
Naitou et al.

(10) Patent No.: US 9,358,602 B2
(45) Date of Patent: Jun. 7, 2016

(54) METHOD FOR PRODUCING PRESS-FORMED PRODUCT

(75) Inventors: Junya Naitou, Kobe (JP); Keisuke Okita, Kobe (JP); Shushi Ikeda, Nagoya (JP)

(73) Assignee: Kobe Steel, Ltd., Hyogo (JP)

( * ) Notice: Subject to any disclaimer, the term of this patent is extended or adjusted under 35 U.S.C. 154(b) by 294 days.

(21) Appl. No.: 13/877,105

(22) PCT Filed: Sep. 30, 2011

(86) PCT No.: PCT/JP2011/072666

§ 371 (c)(1), (2), (4) Date: Mar. 29, 2013

(87) PCT Pub. No.: WO2012/043832

PCT Pub. Date: Apr. 5, 2012

(65) Prior Publication Data

US 2013/0199258 A1 Aug. 8, 2013

(30) Foreign Application Priority Data

Sep. 30, 2010 (JP) ..... 2010-222938

(51) Int. Cl.
*B21D 22/20* (2006.01)
*B21D 37/16* (2006.01)
(Continued)

(52) U.S. Cl.
CPC ..... *B21D 37/16* (2013.01); *B21D 22/20* (2013.01); *B21D 22/208* (2013.01); *B21D 22/22* (2013.01); *B21D 24/02* (2013.01); *B21D 24/04* (2013.01)

(58) Field of Classification Search
CPC .... B21D 22/022; B21D 22/208; B21D 34/16; B21D 37/16; B21D 24/02; B21D 24/04; B21D 24/16; B21D 22/20
USPC ..... 72/342.1
See application file for complete search history.

(56) References Cited

U.S. PATENT DOCUMENTS 6,742,374 B2 * 6/2004 Ozawa ..... B21J 1/06 72/342.4
2005/0257862 A1 11/2005 Asai et al.
2008/0196800 A1 * 8/2008 Beenken ..... B21D 22/022 148/643

FOREIGN PATENT DOCUMENTS

JP 2002-102980 A 4/2002
JP 2004-025247 A 1/2004
(Continued)

OTHER PUBLICATIONS

T. Kunitake, "Prediction of $Ac_1$, $Ac_3$ and Ms Transformation Points of Steel by Empirical Formulae", Heat Treatment, 41(3), 2001, 2 pages.
(Continued)

*Primary Examiner* — Debra Sullivan
(74) *Attorney, Agent, or Firm* — Studebaker & Brackett PC

(57) ABSTRACT

There is provided a useful method for producing a press-formed product without making the structure of a press tool complicated, which product has favorable formability in a level so as to be able to be produced by deep drawing, and which product is produced by press-forming a thin steel sheet with a punch and a die, in which the thin steel sheet is heated to a temperature not lower than an $Ac_3$ transformation point thereof, and the press-forming is then started, wherein the forming is carried out so that a temperature difference in the thin steel sheet is adjusted to be not higher than 200° C. at a stage when the thin steel sheet has reached one third of a forming height.

18 Claims, 2 Drawing Sheets

(51) Int. Cl.

| | |
|---|---|
| ***B21D 22/22*** | (2006.01) |
| ***B21D 24/04*** | (2006.01) |
| ***B21D 24/02*** | (2006.01) |

(56) References Cited

FOREIGN PATENT DOCUMENTS

| | | | |
|---|---|---|---|
| JP | 2004-337923 | A | 12/2004 |
| JP | 2005-014002 | A | 1/2005 |
| JP | 2005-262232 | A | 9/2005 |
| JP | 2005-297042 | A | 10/2005 |
| JP | 2005-329449 | A | 12/2005 |
| JP | 2006-192480 | A | 7/2006 |
| JP | 2007-075835 | A | 3/2007 |
| JP | 2007-275937 | A | 10/2007 |
| JP | 2011-031254 | A | 2/2011 |

OTHER PUBLICATIONS

International Search Report from the International Bureau in corresponding International Application No. PCT/JP2011/072666, mailed Jan. 10, 2012, pp. 1-2 and Written Opinion of International Searching Authority, pp. 1-4.

* cited by examiner

METHOD FOR PRODUCING PRESS-FORMED PRODUCT

TECHNICAL FIELD

The present invention pertains to the filed of producing thin steel sheet formed products to be applied mainly to automobile bodies, and more specifically, the present invention relates to a method for producing press-formed products by heating a steel sheet (blank) as their material to a temperature not lower than an austenite temperature ($Ac_3$ transformation point) thereof and then press-forming the steel sheet into a prescribed shape, in which the steel sheet can be given the shape and at the same time hardened to have prescribed hardness. In particular, the present invention relates to a method for producing press-formed products, which makes it possible to achieve favorable forming in high productivity without causing fracture, crack, or any other defects during the press-forming.

BACKGROUND ART

From the viewpoint of global environment protection, automobile lightening has strongly been desired for the purpose of making fuel-efficient automobiles. When a steel sheet is used for parts composing a vehicle, lightening has been attempted by applying a high-strength steel sheet and reducing the thickness of this steel sheet. On the other hand, to improve the collision safety of automobiles, further strengthening has been required for automobile parts, such as pillars, and there has been an increasing need for ultrahigh-strength steel sheets having higher tensile strength.

However, when thin steel sheets are made to have higher strength, the elongation EL or r value (Lankford value) thereof is lowered, resulting in the deterioration of press formability or shape fixability.

Under these circumstances, to realize high-strength structural parts for automobiles, a hot pressing method (a so-called "hot press method") has been proposed (e.g., Patent Document 1), in which both press-forming and improving the strength of parts by hardening are achieved at the same time. This technique is a method in which a steel sheet is heated up to an austenite (γ) region not lower than an $Ac_3$ transformation point thereof and then hot press-formed, during which the steel sheet is simultaneously hardened by being brought into contact with a press tool at ordinary temperature, to realize ultrahigh strengthening.

According to such a hot pressing method, the steel sheet is formed in a state of low strength, and therefore, the steel sheet exhibits decreased springback (favorable shape fixability), resulting in the achievement of a tensile strength in the 1500 MPa class by rapid cooling. In this regard, such a hot pressing method has been called with various names, in addition to a hot press method, such as a hot forming method, a hot stamping method, a hot stamp method, and a die quenching method.

FIG. 1 is a schematic explanatory view showing the structure of a press tool for carrying out hot press-forming as described above (hereinafter represented sometimes by "hot pressing"). In FIG. 1, reference numerals 1, 2, 3, and 4 represent a punch, a die, a blank holder, and a steel sheet (blank), respectively, and abbreviations BHF, rp, rd, and CL represent a blank holding force, a punch shoulder radius, a die shoulder radius, and a clearance between the punch and the die, respectively. In these parts, punch 1 and die 2 have passage 1*a* and passage 2*a*, respectively, formed in the inside thereof, through which passages a cooling medium (e.g., water) can be allowed to pass, and the press tool is made to have a structure so that these members can be cooled by allowing the cooling medium to pass through these passages.

When a steel sheet is hot pressed (e.g., subjected to hot deep drawing) with such a press tool, the forming is started in a state where a blank (steel sheet 4) is softened by heating to a temperature not lower than an $Ac_3$ transformation point thereof. That is, steel sheet 4 is pushed into a cavity of die 2 (between the parts indicated by reference numerals 2 and 2 in FIG. 1) by punch 1 with steel sheet 4 in a high-temperature state being sandwiched between die 2 and blank holder 3 to form steel sheet 4 into a shape corresponding to the outer shape of punch 1 while reducing the outer diameter of steel sheet 4. In addition, heat is removed from steel sheet 4 to the press tool (punch 1 and die 2) by cooling punch 1 and die 2 in parallel with the forming, and the hardening of a material is carried out by further retaining and cooling steel sheet 4 at the lower dead point in the forming (the point of time when the punch head is positioned at the highest level: the state shown in FIG. 1). Formed products with high dimension accuracy and strength in the 1500 MPa class can be obtained by carrying out such a forming method. Furthermore, such a forming method results in that the volume of a pressing machine can be made smaller because a forming load can be reduced as compared with the case where parts in the same strength class are formed by cold pressing.

In the conventional hot pressing, a steel sheet is heated up to an austenitic region (e.g., about 900° C.) not lower than an $Ac_3$ transformation point thereof, and the steel sheet is then cooled by a press tool for press-forming while being kept in a high-temperature state. Therefore, the steel sheet may easily have a temperature difference between its portion coming into contact with, and its portion not coming into contact with, the press tool composed of punch 1 and die 2, so that strain may be concentrated on its portion becoming relatively high temperature, or so that, for example, in deep drawing, a shrink flange becomes unshrinkable by cooling, both resulting in the deterioration of formability, and in particular, thereby making it difficult to achieve deep drawing.

In the hot pressing, a steel sheet is usually press-formed at about 700° C. to 900° C. and hardened in a press tool, and therefore, the steel sheet should be kept at the lower dead point in the forming (the point of time when the punch head is positioned at the highest level: the state shown in FIG. 1) for a certain period of time, resulting in the deterioration of productivity as compared with cold pressing.

For this reason, various techniques have hitherto been proposed even for increasing productivity. For example, Patent Document 2 discloses a technique of forming a steel sheet, while supplying a lubricant, with a press tool having a lubricant supply port so that a blank holding portion (blank holder 3 shown in FIG. 1) is easily shrunk and the steel sheet easily flows into a vertical wall portion (vertical wall portion of the press tool). However, this technique not only makes the structure of the press tool complicated, but also cannot solve a fundamental problem that the steel sheet easily has a temperature difference therein.

Patent Document 3 discloses a processing method of forming a steel sheet, while successively processing its portion becoming high temperature, and cooling its portion coming to have a smaller sheet thickness. However, even in this technique, the structure of a press toll is made complicated, and for example, in the case of deep drawing, it becomes difficult to maintain a shrink flange at high temperatures.

Patent Document 4 discloses a method of forming a steel sheet, while controlling the displacement of a blank holding portion depending on the sum of sheet thickness and clearance. This technique is effective in the case where a blank holder is a uniform shrink flange such as in cylindrical cup deep drawing. However, complicated forming results in the distribution of the location where wrinkle occurs and the location where wrinkle does not occur, and therefore, contact pressure is increased on crest and trough portions at the location where wrinkle occurs (peaks and bottoms of irregularities) and the temperature of their portions is more lowered, resulting in a distribution of strength in its entirety. As a result, the flowing of a blank into the vertical wall portion becomes unstable, instead resulting in the deterioration of deep drawability.

By the way, when a steel sheet is heated up to an austenite region (e.g., about 900° C.) not lower than an $Ac_3$ transformation point thereof, the steel sheet is exposed to the air for several seconds when being moved from a heating oven to a press-forming machine, resulting in the formation of oxide layers (scales) on the surface of the steel sheet. The scales fall out in the press-forming, which become the cause for the formation of press marks and other defects. Furthermore, the presence of such scale marks deteriorates the application of a corrosion-resistant coating, and therefore, it becomes necessary to remove the scales by peening or any other treatment after the press-forming.

As an attempt to avoid the disadvantages caused by the formation of scales, surface-treated steel sheets, such as aluminized, galvanized, or galvannealed steel sheets, have been used as a material (blank) for press-forming, but this attempt has another disadvantage that surface treatment drives costs up and requires long time at the stage of heating (makes it impossible to heat the steel sheets rapidly in order to keep plated layers and achieve alloying). Furthermore, the formation of scales may also be avoided by controlling the atmosphere in a heating oven or around a press-forming machine, but this is not realistic because of its need for a large-sized apparatus.

PRIOR ART DOCUMENTS

Patent Documents

Patent Document 1: Japanese Patent Laid-open Publication (Kokai) No. 2002-102980

Patent Document 2: Japanese Patent Laid-open Publication (Kokai) No. 2007-75835

Patent Document 3: Japanese Patent Laid-open Publication (Kokai) No. 2006-192480

Patent Document 4: Japanese Patent Laid-open Publication (Kokai) No. 2005-297042

SUMMARY OF THE INVENTION

Problems to be Solved by the Invention

The present invention has been made in view of the above-described circumstances, and its object is to provide a method for producing press-formed products without making the structure of a press tool complicated and without causing disadvantages by the unavoidable formation of scales on the surface of a steel sheet, which products have favorable formability in a level so as to be able to be produced by deep drawing.

Means for Solving the Problems

The method of the present invention for producing a press-formed product, which method was able to achieve the object described above, is characterized in that when a formed product is produced by press-forming a thin steel sheet with a punch and a die, the thin steel sheet is heated to a temperature not lower than an $Ac_3$ transformation point thereof, and the forming is then started, wherein the forming is carried out so that a temperature difference in the thin steel sheet is adjusted to be not higher than 200° C. at a stage when the thin steel sheet has reached one third of a forming height.

As a specific method for forming a thin steel sheet so that a temperature difference in the thin steel sheet is adjusted to be not higher than 200° C., there can be mentioned an embodiment where the forming is carried out so that the time from the start of the forming to the finish of the forming is adjusted to be not longer than 0.3 seconds.

In the method of the present invention, the forming may be started at a temperature higher than a martensitic transformation start temperature Ms of the steel sheet (more specifically, the forming is started at a temperature not higher than 800° C.), but the forming may also be started at a temperature not higher than a martensitic transformation start temperature Ms of the steel sheet. In particular, when the forming of a steel sheet is started at a temperature not higher than a martensitic transformation start temperature Ms of the steel sheet, it does not cause disadvantages by the formation of scales on the surface of the steel sheet.

In addition, the method of the present invention is particularly effective when drawing is carried out with a blank holder, and even if it is applied to such a forming method, favorable formability can be secured without making the structure of a press tool complicated and without causing fracture or crack.

Effect of the Invention

According to the present invention, it became possible favorable forming without causing fracture, crack, or any other defects during the forming because a thin steel sheet is heated to a temperature not lower than an $Ac_3$ transformation point thereof, and the thin steel sheet is then formed so that a temperature difference in the thin steel sheet is adjusted to be not higher than 200° C. at a stage when the thin steel sheet has reached one third of a forming height from the start of the forming.

MODE FOR CARRYING OUT THE INVENTION

The present inventors have studied from various angles to produce press-formed products having favorable formability in high productivity without causing fracture, crack, or any other defects during the forming when a thin steel sheet is heated to a temperature not lower than an $Ac_3$ transformation point thereof and then press-formed. As a result, they have found that favorable formability can be secured, if a thin steel sheet is heated to a temperature not lower than an $Ac_3$ transformation point $Ac_3$ thereof and the forming is carried out so that a temperature difference in the thin steel sheet is adjusted to be not higher than 200° C. at a stage when the thin steel sheet has reached one third of a forming height from the start of the forming, thereby completing the present invention.

The "forming height" as used in the present invention refers to the height of a product after press-forming. In the present invention, favorable formability can be secured, if a temperature difference in a thin steel sheet is not higher than 200° C. at a stage when the thin steel sheet has reached one third of a forming height (this stage is referred to sometimes as the "early stage of forming") from the start of the press-forming. However, a subsequent temperature difference may become greater depending on the forming conditions (cooling conditions). That is, as described below, a means for controlling a temperature difference to be not higher than 200° C. may include the "case of acting so that a temperature difference becomes smaller (e.g., the case of heating a press tool from the beginning)" and the "case of acting so that a temperature difference becomes greater (e.g., the case of increasing the forming rate)". In the former case, there is no problem because a temperature difference becomes smaller from the early stage of forming to the finish of the forming. In the latter case, however, even if there is no temperature difference (not higher than 200° C.) at the early stage of forming, a subsequent temperature difference may sometimes become greater (e.g., the case of increasing the forming rate in the beginning and decreasing the forming rate later). Even when such a method is adopted, a temperature difference as described above may preferably be secured at the final stage. In this regard, however, even in such a case, favorable formability can be exhibited, if a temperature difference is secured to be not higher than 350° C. at the final stage.

Figure 1:
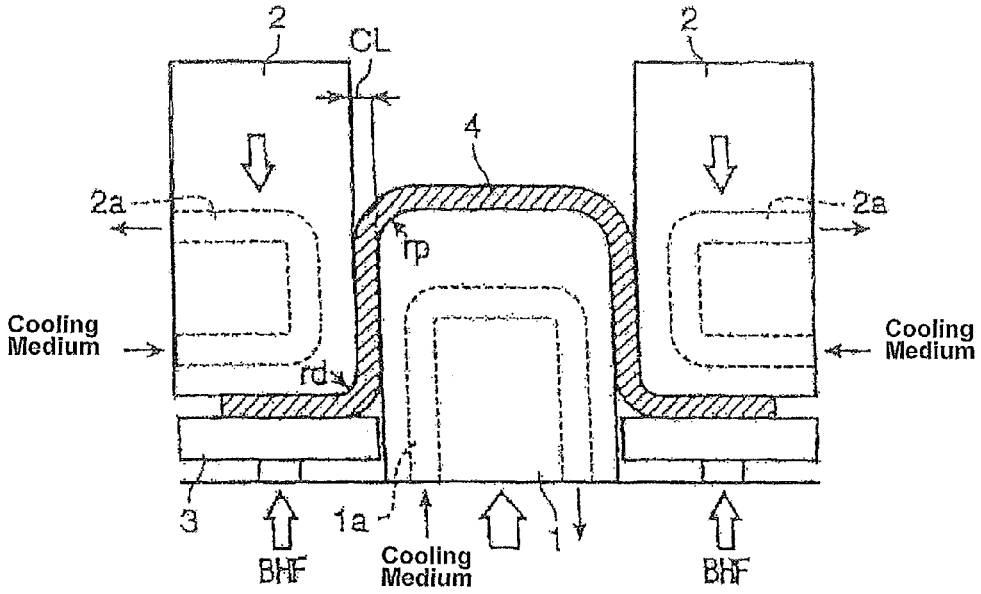
FIG. 1 is a schematic explanatory view showing the structure of a press tool for carrying out hot press-forming.

For example, when deep drawing is carried out with a press tool having a structure shown in FIG. 1, a blank portion (portion sandwiched between die 2 and blank holder 3) corresponding to a blank holder (blank holder 3 shown in FIG. 1) is lower in temperature than other blank portions. In such a state, a temperature difference may easily become generated in the blank (steel sheet).

The present inventors have made a cylindrical tube drawing experiment in which a steel sheet with a chemical element composition shown in Table 1 below is first heated to 900° C. (this steel sheet has an $Ac_3$ transformation point of 830° C. and a martensitic transformation start temperature Ms of 411° C.) and then subjected to cylindrical cup drawing by the above-described procedure (with respect to the other detailed conditions, see Example below) with a press tool (press tool temperature: 20° C.) shown in FIG. 1 above. As a result, they have found that the steel sheet has early reached the limit of forming, if the press-forming is started at 800° C., but it becomes possible to achieve favorable formability and therefore to make deep drawing to the lower dead point in the forming, if the press-forming is started at 600° C. (after rapidly cooling down to 600° C. at a cooling rate not lower than a critical cooling rate).

TABLE 1

| Chemical element composition (wt %) of blank* | | | | | | | | | | | |
|---|---|---|---|---|---|---|---|---|---|---|---|
| C | Si | Mn | P | S | Cu | Al | Ni | Cr | Ti | B | N |
| 0.23 | 0.18 | 1.28 | 0.013 | 0.002 | 0.08 | 0.041 | 0.01 | 0.21 | 0.023 | 0.0029 | 0.0041 |

*Remainder: iron and unavoidable impurities other than P, S, and N

The cause for the occurrence of phenomenon described above was studied by numerical analysis in the simulation with an axisymmetric model. As a result, when the press-forming was started at 800° C., the temperature of a high-temperature portion of the steel sheet was 780° C. and the temperature of a low-temperature portion (a portion corresponding to a blank holding portion) of the steel sheet was 540° C., both at the stage when the steel sheet had reached one third of a forming height, a temperature difference of which became 240° C. On the other hand, when the press-forming was started at 600° C., the temperature of a high-temperature portion of the steel sheet was 580° C. and the temperature of a low-temperature portion (a portion corresponding to a blank holding portion) of the steel sheet was 420° C., both at the stage when the steel sheet has reached one third of a forming height, a temperature difference of which became 160° C.

Furthermore, in the case where the same steel sheet as described above was used and the press tool temperature was set to be 20° C. or 600° C., a study was made on a state when the steel sheet was press-formed at a start temperature of 800° C. or 750° C. As a result, when the press tool temperature was set to be 20° C., the steel sheet had early reached the limit of forming in any case where the forming start temperature was 800° C. or 750° C., but when the press tool temperature was set to be 600° C., it becomes possible to achieve favorable formability and therefore to make deep drawing to the lower dead point in the forming, in any case where the forming start temperature was 800° C. or 750° C.

Further studies were made on the basis of these results. As a result, it was found that favorable formability can be secured until the end of forming when a thin steel sheet is heated to a temperature not lower than an $Ac_3$ transformation point thereof, and a temperature difference in the thin steel sheet is adjusted to be not higher than 200° C. at the early stage of forming when the thin steel sheet has reached one third of a forming height from the start of the forming.

Figure 2:
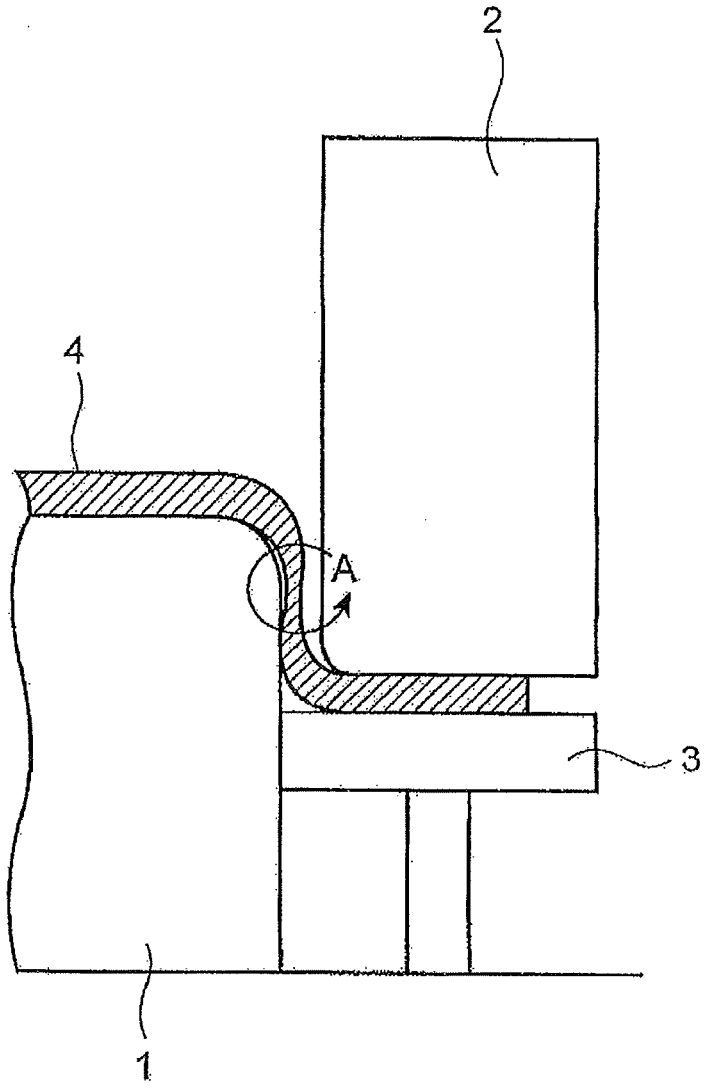
FIG. 2 is an explanatory view showing a state where a steel sheet has early reached the limit of forming.

The cause for the occurrence of such a phenomenon can be considered as follows. That is, if the thin steel sheet has a temperature distribution in which a temperature difference in the thin steel sheet is higher than 200° C. at the early stage of forming when the thin steel sheet has reached one third of a forming height from the start of the forming, it is considered that the thin steel sheet falls into a state of easily causing local deformation (a locally deformed portion is indicated by A in FIG. 2) during the forming as shown in FIG. 2, resulting in the deterioration of formability. On the other hand, if a temperature difference in the thin steel sheet is not higher than 200° C. at the early stage of forming, it is considered that the thin steel sheet falls into a state of hardly causing local deformation as described above, resulting in the exhibition of favorable formability. The temperature difference described above may preferably be not higher than 150° C. (more preferably not higher than 100° C.). If the temperature difference is adjusted to be low in a too much strict manner, the control of the temperature difference becomes difficult, resulting in the deterioration of workability.

As a means for adjusting a temperature differential in a thin steel sheet to be not higher than 200° C. at the early stage of forming from the start of press-forming, various methods can be adopted, such as methods (1) to (4) below.

(1) Controlling the forming start temperature and the press tool temperature to control a temperature difference in the steel sheet to be low [e.g., lowering the forming start temperature or raising the press tool temperature (or both are used in combination)].

(2) Controlling the forming rate (e.g., increasing the forming rate so that the time of heat conduction is shortened between the steel sheet and the press tool).

(3) Decreasing a heat transfer coefficient between the blank and the press tool (e.g., ceramics is used as a material of the press tool to make difficult heat transfer from the steel sheet to the press tool).

(4) Forming the steel sheet while cooling portions other than a blank holding portion (e.g., forming the steel sheet while supplying air or a cooling gas to the press tool).

The method of the present invention can achieve the above-described effect, if it meets the requirement that "a temperature different in the thin steel sheet is not higher than 200° C." in the early stage of forming. The forming start temperature is not particularly limited, and the forming may be started at a temperature higher than a martensitic transformation start temperature Ms of the thin steel sheet, or the forming may be started at a temperature not higher than a martensitic transformation start temperature Ms of the thin steel sheet. In particular, when the forming of a steel sheet is started at a temperature not higher than a martensitic transformation start temperature Ms of the steel sheet, the steel sheet falls into a temperature range where the surface oxidation of the steel sheet hardly occurs, and therefore, it leads to an additional advantage that the formation of scales on the surface of the steel sheet can be avoided.

The $Ac_3$ transformation point of the steel sheet shown in Table 1 above means an austenite transformation completion temperature $Ac_3$ when the steel sheet is heated, and it can be calculated by formula (1) below. In addition, the martensitic transformation start temperature Ms described above is a value calculated by formula (2) below (see, e.g., "Heat Treatment," 41(3), 164-169, 2001, Tatsuro KUNITAKE, "Prediction of $Ac_1$, $Ac_3$, and Ms Transformation Points of Steel by Empirical Formulae").

$$Ac_3 \text{ transformation point } (^\circ \text{C.}) = -230.5\times[C]+31.6\times[Si]-20.4\times[Mn]-39.8\times[Cu]-18.1\times[Ni]-14.8\times[Cr]+16.8\times[Mo]+912 \quad (1)$$

$$Ms\ (^\circ \text{C.}) = 560.5-\{407.3\times[C]+7.3\times[Si]+37.8\times[Mn]+20.5\times[Cu]+19.5\times[Ni]+19.8[Cr]+4.5\times[Mo]\} \quad (2)$$

where [C], [Si], [Mn], [Cu], [Ni], [Cr], and [Mo] indicate C, Si, Mn, Cu, Ni, Cr, and Mo contents (wt %), respectively.

The method of the present invention can achieve the above-described object by appropriately controlling a temperature distribution in a steel sheet at the early stage of forming. Such an effect becomes prominently exhibited when a steel sheet is subjected to cylindrical cup deep drawing (i.e., forming liable to cause a temperature distribution) with a press tool having a blank holder. In this regard, however, the method of the present invention is construed to include the case where a steel sheet is subjected to square cup deep drawing and the case where a steel sheet is subjected to ordinary press-forming (e.g., stretch forming), and the effect of the present invention can be achieved even in the case where formed products are produced by any of such methods. Furthermore, the method of the present invention only needs the control of a temperature distribution in a steel sheet but does not need making the structure of a press tool complicated.

The following will describe the present invention in detail by way of Examples, but the present invention is not limited to the Examples described below. The present invention can be put into practice after appropriate modifications or variations within a range capable of meeting the gist described above and below, all of which are included in the technical scope of the present invention.

EXAMPLES

Steel with a chemical element composition shown in Table 1 above was rolled to have a thickness of 1.0 mm or 1.4 mm by an ordinary means. This steel sheet was punched out into round blanks having a diameter (blank diameter) of 100 mm for experiments (therefore, these blanks had an $Ac_3$ transformation point of 830° C. and a martensitic transformation start temperature Ms of 411° C.).

The round blanks were subjected to cylindrical cup drawing with a press tool, in which the head shape of a punch was round (49.75 mm in diameter), (i.e., a cylindrical cup die and a cylindrical cup punch), (see FIG. 1 above), according to the method of the present invention. At that time, the blanks were heated with an electric oven (the atmosphere of which was not controlled), the heating temperature of which was set to be 900° C.

The forming experiments were carried out with a press tool shown in FIG. 1 above, which was placed in a crank press machine. The time (forming time) from the contact of the press tool with the blank to the stop of the press tool at the lower dead point in the forming was adjusted in the range of from 0.1 seconds to 0.7 seconds to adjust a temperature difference in each steel sheet. The other press-forming conditions are as described below.

(The other press-forming conditions)

Blank holding force: 3 tons

Die shoulder radius rd: 5 mm

Punch shoulder radius rp: 5 mm

Clearance CL between punch and die: 1.32/2+[1.0 or 1.4 (steel sheet thickness)] mm Forming height: 37 mm The results are shown in Table 2 below. In Table 2, the letter "A" indicates that favorable formability was achieved without causing fracture or crack and it was possible to make deep drawing to the lower dead point in the forming (the state shown in FIG. 1 above), and the letter "B" indicates that fracture or crack was caused during the forming (e.g., the state shown in FIG. 2 above). In addition, with respect to each of the thin steel sheets which were able to undergo the forming, a temperature difference in the thin steel sheet at the early stage of forming was measured with a laser beam radiation thermometer, and a temperature distribution during the forming was calculated by numerical simulation, both of which were found to be controlled not higher than 200° C. On the other hand, in each of the steel sheets which caused fracture or crack during the forming, a temperature difference in the steel sheet at the early stage of forming was found to become higher than 200° C.

TABLE 2

| Sheet thickness (mm) | Forming time (sec.) | Forming start temperature (° C.) | Temperature difference in blank at time of ⅓ forming (° C.) | Forming results |
|---|---|---|---|---|
| 1.0 | 0.1 | 800 | 155 | A |
| 1.0 | 0.1 | 750 | 165 | A |
| 1.0 | 0.3 | 800 | 205 | B |
| 1.0 | 0.3 | 750 | 190 | A |
| 1.4 | 0.3 | 800 | 180 | A |
| 1.4 | 0.3 | 750 | 175 | A |
| 1.0 | 0.5 | 800 | 235 | B |
| 1.0 | 0.5 | 750 | 225 | B |

TABLE 2-continued

| Sheet thickness (mm) | Forming time (sec.) | Forming start temperature (° C.) | Temperature difference in blank at time of ⅓ forming (° C.) | Forming results |
|---|---|---|---|---|
| 1.4 | 0.5 | 800 | 215 | B |
| 1.4 | 0.5 | 750 | 195 | A |
| 1.4 | 0.7 | 800 | 260 | B |
| 1.4 | 0.7 | 750 | 240 | B |

As can be seen from these results, it is understood that favorable formability can be secured by adjusting the forming time (i.e., forming rate) (and preferably further adjusting the forming start temperature) to avoid the formation of a temperature distribution.

INDUSTRIAL APPLICABILITY

The method of the present invention includes heating a thin steel sheet to a temperature not lower than an $Ac_3$ transformation point thereof and then starting the press-forming, wherein the forming is carried out so that a temperature difference in the thin steel sheet is adjusted to be not higher than 200° C. at a stage when the thin steel sheet has reached one third of a forming height. Thus, the method of present invention makes it possible to produce press-formed products having favorable formability in a level so as to be able to be produced by deep drawing.

EXPLANATION OF NUMERALS

1 Punch
2 Die
3 Blank holder
4 Blank (steel sheet)

The invention claimed is:

1. A method for producing a formed product by press-forming a thin steel sheet with a punch and a die, comprising:
heating the thin steel sheet to a temperature not lower than an $Ac_3$ transformation point thereof;
then starting the press-forming; and
cooling the thin steel sheet after starting the press-forming,
wherein the press-forming is carried out so that a temperature difference between different areas of the thin steel sheet is adjusted via the cooling to be not higher than 200° C. at a stage when the thin steel sheet has reached one third of a forming height, and the press-forming is carried out so that the time from the start of the press-forming to the finish of the press-forming is adjusted to be not longer than 0.3 seconds.

2. The production method according to claim 1, wherein the press-forming is carried out by drawing with a blank holder.

3. The production method according to claim 1, wherein the cooling comprises controlling a forming start temperature, a temperature of the punch and a temperature of the die.

4. The production method according to claim 1, wherein the cooling comprises controlling a forming rate.

5. The production method according to claim 1, wherein the cooling comprises decreasing a heat transfer coefficient between the thin steel sheet, the punch and the die.

6. The production method according to claim 1, wherein the cooling comprises the press-forming of the thin steel sheet while cooling portions of the thin steel sheet not in contact with a blank holder.

7. A method for producing a formed product by press-forming a thin steel sheet with a punch and a die, comprising:
heating the thin steel sheet to a temperature not lower than an $Ac_3$ transformation point thereof;
performing a first cooling to the thin steel sheet;
then starting the press-forming; and
performing a second cooling to the thin steel sheet after starting the press-forming,
wherein the press-forming is started at a temperature higher than a martensitic transformation start temperature Ms of the thin steel sheet and not higher than 800° C., and the press-forming is carried out so that a temperature difference between different areas of the thin steel sheet is adjusted via the second cooling to be not higher than 200° C. at a stage when the thin steel sheet has reached one third of a forming height.

8. The production method according to claim 7, wherein the press-forming is carried out by drawing with a blank holder.

9. The production method according to claim 7, wherein the second cooling comprises controlling a forming start temperature, a temperature of the punch and a temperature of the die.

10. The production method according to claim 7, wherein the second cooling comprises controlling a forming rate.

11. The production method according to claim 7, wherein the second cooling comprises decreasing a heat transfer coefficient between the thin steel sheet, the punch and the die.

12. The production method according to claim 7, wherein the second cooling comprises the press-forming of the thin steel sheet while cooling portions of the thin steel sheet not in contact with a blank holder.

13. A method of producing a formed product by press-forming a thin steel sheet with a punch and a die, comprising:
heating the thin steel sheet to a temperature not lower than an $Ac_3$ transformation point thereof;
performing a first cooling to the thin steel sheet;
then start the press-forming; and
performing a second cooling to the thin steel sheet after starting the press-forming,
wherein the press-forming is started at a temperature not higher than a martensitic transformation start temperature Ms of the thin steel sheet, and the press-forming is carried out so that a temperature difference between different areas of the thin steel sheet is adjusted via the second cooling to be not higher than 200° C. at a stage when the thin steel sheet has reached one third of a forming height.

14. The production method according to claim 13, wherein the press-forming is carried out by drawing with a blank holder.

15. The production method according to claim 13, wherein the second cooling comprises controlling a forming start temperature, a temperature of the punch and a temperature of the die.

16. The production method according to claim 13, wherein the second cooling comprises controlling a forming rate.

17. The production method according to claim 13, wherein the second cooling comprises decreasing a heat transfer coefficient between the thin steel sheet, the punch and the die.

18. The production method according to claim 13, wherein the second cooling comprises the press-forming of the thin steel sheet while cooling portions of the thin steel sheet not in contact with a blank holder.

* * * * *